US007808189B2

(12) United States Patent
Hollnberger et al.

(10) Patent No.: US 7,808,189 B2
(45) Date of Patent: Oct. 5, 2010

(54) LED CIRCUIT ARRANGEMENT HAVING A DIODE RECTIFIER

(75) Inventors: Peter Hollnberger, Nittendorf (DE); Michael Rasp, Nittendorf (DE); Markus Hofmann, Bad Abbach (DE)

(73) Assignee: Osram Opto Semiconductors GmbH, Regensburg (DE)

( * ) Notice: Subject to any disclaimer, the term of this patent is extended or adjusted under 35 U.S.C. 154(b) by 577 days.

(21) Appl. No.: 11/238,690

(22) Filed: Sep. 29, 2005

(65) Prior Publication Data

US 2006/0071806 A1 Apr. 6, 2006

(30) Foreign Application Priority Data

Sep. 30, 2004 (DE) ..... 10 2004 047 681

(51) Int. Cl.
*H05B 37/02* (2006.01)

(52) U.S. Cl. ..... 315/291; 315/209 R; 315/224

(58) Field of Classification Search ..... 315/291
See application file for complete search history.

(56) References Cited

U.S. PATENT DOCUMENTS

| | | | | |
|---|---|---|---|---|
| 4,039,850 | A * | 8/1977 | Winter | 307/11 |
| 4,234,926 | A * | 11/1980 | Wallace et al. | 702/188 |
| 4,379,988 | A * | 4/1983 | Mattatall | 320/108 |
| 6,552,424 | B2 * | 4/2003 | Farrar | 257/686 |
| 6,617,795 | B2 * | 9/2003 | Bruning | 315/151 |
| 2002/0075677 | A1 * | 6/2002 | Dokoupil | 362/226 |
| 2004/0114384 | A1 * | 6/2004 | Carter et al. | 362/494 |

FOREIGN PATENT DOCUMENTS

| | | |
|---|---|---|
| DE | 295 11 022 U1 | 11/1995 |
| DE | 196 51 140 A1 | 6/1997 |
| DE | 101 03 422 A1 | 8/2002 |
| EP | 1 320 284 A2 | 6/2003 |
| WO | WO 97/22147 | 6/1997 |

OTHER PUBLICATIONS

King, et al, Directing Current, Hands on Physics, 2002, http://hop.concord.org/e1/e1e3.html.*

Darwish, et al, A Novel Technique for smoothing DC Ripple in Rectifier Circuits, IEEE Xplore, 1990, http://ieeexplore.ieee.org/xpls/abs_all.jsp?arnumber=114654.*

F. Eckhold: "Leuchtdioden Richtig eingesetzt" (Abstract), Elektronik Applikation, Sonderausgabe, Nov. 1986, pp. 24-35.

* cited by examiner

*Primary Examiner*—Douglas W Owens
*Assistant Examiner*—Jae K Kim
(74) *Attorney, Agent, or Firm*—Cohen Pontani Lieberman & Pavane LLP

(57) ABSTRACT

An LED circuit arrangement including an AC voltage source for providing a voltage supply. A diode rectifier is provided and has at least one rectifier diode, which can be a radiation-emitting LED chip. The LED circuit arrangement also includes at least one radiation-emitting LED chip which simultaneously functions as a luminous element and as a rectifier diode.

19 Claims, 2 Drawing Sheets

LED CIRCUIT ARRANGEMENT HAVING A DIODE RECTIFIER

RELATED APPLICATION

This patent application claims the priority of German patent application 10 2004 047 681.0 filed Sep. 30, 2004, the disclosure content of which is hereby incorporated by reference.

FIELD OF THE INVENTION

The invention relates to an LED circuit arrangement in which an AC voltage source provides a voltage supply and which has a diode rectifier.

BACKGROUND OF THE INVENTION

Since LEDs are distinguished by high efficiency and a long life, they are being used more and more often for illumination purposes in which incandescent lamps have hitherto usually been used. If an LED illumination device is to be operated using a mains voltage, for example an AC voltage of approximately 220 V or 110 V, a power supply unit containing a transformer and a rectifier will generally be connected upstream of the LED illumination device. The transformer transforms the mains voltage to a lower voltage which is usually less than 15 V. A rectifier, for example a half-wave rectifier or a bridge rectifier, uses the low-voltage AC voltage at the output of the transformer to generate a DC voltage. The rectifiers used are, for example, diode rectifiers which are fitted with one diode in the case of the half-wave rectifier or with four diodes in the case of the bridge rectifier.

In the case of LED illumination devices which are to be mass-produced in a cost-effective manner, it is often desired to minimize the number of components contained in the electronic circuit arrangement in order to reduce the production cost. This aim is pursued, in particular, in the case of circuit arrangements which contain wired components since the cost of wiring associated with each additional component in such circuit arrangements gives rise to a comparatively large proportion of the total production costs. However, it is also advantageous to reduce the number of components in the case of components which are constructed as surface-mounted devices in order to reduce the cost of assembly.

SUMMARY OF THE INVENTION

One object of the invention is to provide an improved LED circuit arrangement in which an AC voltage source provides a voltage supply and which is distinguished, in particular, by a particularly small number of electronic components used and thus a comparatively low production cost.

This and other objects are attained in accordance with one aspect of the present invention directed to an LED circuit arrangement in which an AC voltage source provides a voltage supply and which has a diode rectifier, the diode rectifier comprises, according to the invention, at least one rectifier diode which is a radiation-emitting LED chip.

The radiation-emitting LED chip advantageously serves a dual function in the LED circuit arrangement. It is used, on the one hand, as a luminous means and, on the other hand, to rectify the AC voltage. The production cost, in particular the cost of assembly and/or wiring, is therefore advantageously low in comparison with a conventional LED circuit arrangement which, in addition to one or more radiation-emitting LED chip(s), contains one or more conventional semiconductor diode(s) as rectifier diode(s).

The diode rectifier is, for example, a half-wave rectifier. The half-wave rectifier contains only one radiation-emitting LED chip as a rectifier diode and is distinguished by a particularly low production cost.

The diode rectifier can be in the form of a bridge rectifier whose rectifier diodes are radiation-emitting LED chips. In the case of a bridge rectifier containing four radiation-emitting LED chips, a current respectively flows through two LED chips during the positive and the negative half-wave of the AC voltage and said chips emit radiation. This reduces flickering of the LED chips at the frequency of the AC voltage in comparison with a half-wave rectifier.

The circuit arrangement can contain at least one further radiation-emitting LED chip which is operated as a load on the diode rectifier. In the case of the half-wave rectifier, it is particularly advantageous if a capacitor for smoothing the pulsating DC voltage generated by the diode rectifier is connected in parallel with the LED chip which is operated as a load on the diode rectifier. A smoothing capacitor of this type makes it possible for a current to flow through the radiation-emitting LED chip (which is operated as a load) both during the positive and during the negative half-wave of the AC voltage which is used to operate the circuit arrangement. This reduces, in particular, flickering of the radiation-emitting LED chip (which is operated as a load) at the frequency of the AC voltage, said frequency being, for example, approximately 50 Hz.

In the case of a bridge rectifier circuit containing four radiation-emitting LED chips, a further radiation-emitting LED chip or preferably a plurality of further radiation-emitting LED chips may also be operated as a load on the bridge rectifier. The bridge rectifier has the advantage that a current flows through the at least one LED chip (which is operated as a load) during both half-waves of the AC voltage. In order to smooth the pulsating DC voltage generated by the bridge rectifier, the circuit arrangement advantageously contains a smoothing capacitor.

The LED circuit arrangement can comprise at least one multichip LED containing a plurality of radiation-emitting LED chips in a common housing. The multichip LED can contain at least one radiation-emitting LED chip, which is the rectifier diode of the diode rectifier, and at least one further radiation-emitting LED chip which is operated as a load on the diode rectifier.

In the case of the radiation-emitting LED chip which is operated as a load, flickering of the emitted radiation at the frequency of the AC voltage can be reduced by means of a smoothing capacitor and/or by using a bridge rectifier circuit such that it cannot be perceived by the human eye. The at least one LED chip which is the rectifier diode of the diode rectifier can be arranged at such a short distance from the LED chip which is operated as a load that possible flickering of the LED chip which is used as the rectifier diode is masked by the LED chip which is operated as a load such that it cannot be perceived by the human eye.

The LED circuit arrangement can contain two multichip LEDs each containing three radiation-emitting LED chips, each multichip LED containing two radiation-emitting LED chips, which are part of the bridge rectifier circuit, and one radiation-emitting LED chip which is operated as a load on the bridge rectifier circuit. A plurality of LED circuit arrangements of this type can also be connected in parallel.

The radiation-emitting LED chips of the multichip LED can emit light of the same color. The multichip LED may, for example, be an LED which emits white light and contains a plurality of radiation-emitting LED chips which emit blue or ultraviolet light that is converted into white light using luminescence conversion substances. Using LED chips which emit the same color advantageously prevents the color impression of the multichip LED being distorted or flickering, which could otherwise result, for example in the case of additive color mixing using differently colored LED chips, by virtue of the fact that the differently colored LED chips emit during different half-waves of the AC voltage applied.

The LED circuit arrangement can contain at least one electronic component for smoothing a DC voltage that is generated by the diode rectifier. As previously described in connection with the half-wave rectifier and the bridge rectifier, the electronic component is a capacitor, for example. Alternatively, other circuit variants which may also comprise a plurality of electronic components are also conceivable.

The LED circuit arrangement can contain a transformer. This is advantageous, in particular, when a mains voltage is provided as the AC voltage source. In this case, the mains voltage which is, for example, approximately 220 V or 110 V is transformed to an operating voltage which is customary for LED circuit arrangements and is typically less than 15 V.

An LED circuit arrangement according to the invention may be contained, in particular, in a low-voltage luminous means which is operated using a voltage of preferably 12 V. The LED circuit arrangement is thus, in particular, an alternative to conventional halogen lamps. The low-voltage luminous means can comprise a housing having a reflector made from a metallized glass or plastic.

Furthermore, an LED circuit arrangement according to the invention may also be used as a power supply unit in which the radiation-emitting LED chip which functions as a rectifier diode simultaneously signals operation of the power supply unit, with the result that it is possible to dispense with an additional optical function display.

DETAILED DESCRIPTION OF THE DRAWINGS

Identical or identically acting elements are provided with the same reference symbols in the Figures.

Figure 1:
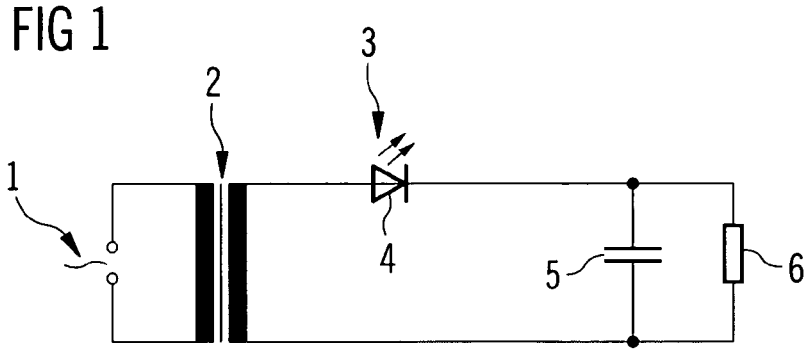
FIG. 1 shows a schematic illustration of a circuit diagram of an LED circuit arrangement in accordance with a first exemplary embodiment of the invention.

The LED circuit arrangement illustrated in FIG. 1 contains an AC voltage source 1. The AC voltage source 1 is preferably a mains voltage, that is to say an AC voltage of 110 V or 220 V, for example. The LED circuit arrangement also contains a transformer 2 which is used to transform the AC voltage generated by the AC voltage source 1 to an operating voltage which is suitable for LED circuit arrangements. The LED circuit arrangement contains a half-wave rectifier 3 in which the rectifier diode is a radiation-emitting LED chip 4.

The half-wave rectifier 3 is operated with a load 6 which is an ohmic resistor, for example. A capacitor 5 is preferably connected in parallel with the load 6 in order to smooth the pulsating DC voltage generated by the diode rectifier 3.

The load 6 may be any desired electronic component, for example a standard electronic component which is operated using a low-voltage DC voltage, the transformer 2, in conjunction with the diode rectifier 3, having the function of a power supply unit. In this case, operation of the power supply unit is advantageously optically signaled by the LED chip 4 which functions as the diode rectifier 3.

Alternatively, the load 6 may also be at least one further radiation-emitting LED chip.

Figure 2:
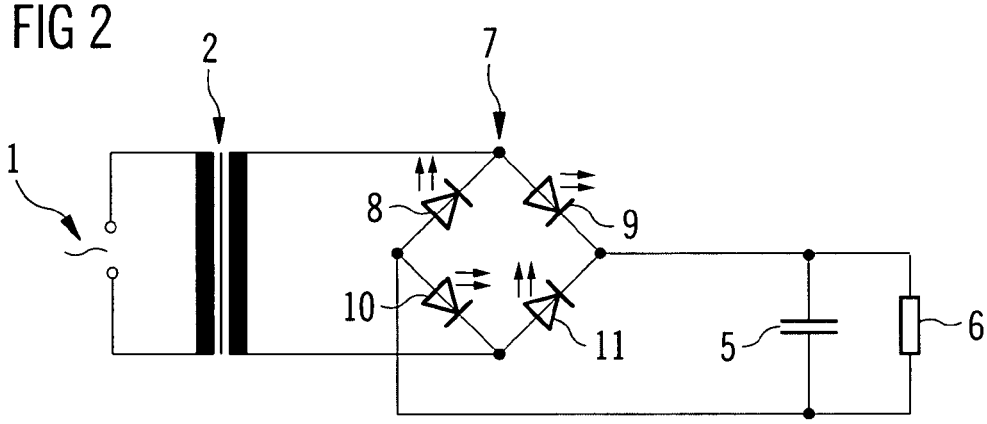
FIG. 2 shows a schematic illustration of a circuit diagram of an LED circuit arrangement in accordance with a second exemplary embodiment of the invention.

Like the first exemplary embodiment of the invention, the second exemplary embodiment (illustrated in FIG. 2) of the invention contains an AC voltage source 1, a transformer 2, a smoothing capacitor 5 and a load 6. In this exemplary embodiment, the diode rectifier is a bridge rectifier 7 which contains four radiation-emitting LED chips 8, 9, 10, 11. In comparison with the previously described half-wave rectifier 3, the bridge rectifier 7 has the advantage that two of the four radiation-emitting LED chips are respectively forward-biased and thus emit radiation both during the positive and during the negative half-wave of the AC voltage. This advantageously reduces flickering at the frequency of the AC voltage. The bridge rectifier 7 consequently outputs a voltage to the load 6 both during the positive and during the negative half-wave of the AC voltage applied.

In the third exemplary embodiment (illustrated in FIG. 3) of the invention, two radiation-emitting LED chips 12, 13 are operated as a load on the bridge rectifier 7. As previously described, the bridge rectifier 7 outputs a voltage to the LEDs 12, 13 (which are operated as a load) both during the positive and the negative half-wave of the AC voltage applied. In this circuit, the LEDs 12, 13 are additionally forward-biased during both half-waves of the AC voltage. This advantageously reduces flickering of the radiation-emitting LED chips 12, 13 (which are operated as a load) at the frequency of the AC voltage.

Figure 3:
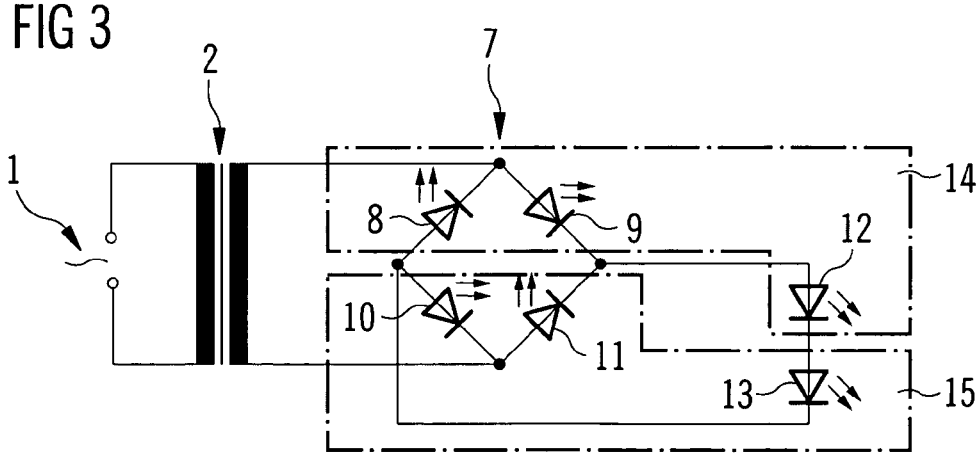
FIG. 3 shows a schematic illustration of a circuit diagram of an LED circuit arrangement in accordance with a third exemplary embodiment of the invention.

Of the six radiation-emitting LED chips 8, 9, 10, 11, 12, 13 of the LED circuit arrangement illustrated in FIG. 3, two LED chips 8, 10 of the bridge rectifier circuit 7 and the two LED chips 12, 13 which are operated as a load therefore respectively emit during the positive half-wave of the AC voltage. The two further LED chips 9, 11 of the bridge rectifier circuit 7 and likewise the two LED chips 12, 13 which are operated as a load emit during the negative half-wave of the AC voltage.

The radiation-emitting LED chips 8, 9, 10, 11, 12, 13 of the LED circuit arrangement may, for example, be contained in discrete LEDs which each have an LED housing. Furthermore, the radiation-emitting LED chips 8, 9, 10, 11, 12, 13 may also be contained in a common housing in an LED module.

In one particularly preferred variant of the invention, three of the six LED chips of the LED circuit arrangement illustrated in FIG. 3 are respectively contained in a multichip LED 14, 15. As indicated in FIG. 3 by the areas enclosed by dashed lines, a first multichip LED 14 contains, for example, two radiation-emitting LED chips 8, 9 of the bridge rectifier 7 and one radiation-emitting LED chip 12 which is operated as a load 6 on the bridge rectifier 7. A second multichip LED 15 contains the two further radiation-emitting LED chips 10, 11 of the bridge rectifier 7 and a further LED chip 13 which is operated as a load.

In this arrangement, flickering of the multichip LEDs 14, 15 is advantageously reduced by virtue of the fact that, of the three LED chips which are arranged within a multichip LED 14, 15, one LED chip 8, 11 is forward-biased during a first half-wave of the AC voltage, a further LED chip 9, 10 is forward-biased during the second half-wave of the AC voltage and a third LED chip 12, 13 is forward-biased during both half-waves of the AC voltage. Two of the three LED chips thus respectively emit radiation at the same time. Since the three radiation-emitting LED chips are generally at a very short distance from one another within the multichip LED 14, 15, flickering cannot be perceived by the human eye at a typical mains frequency of approximately 50 Hz.

Figure 4:
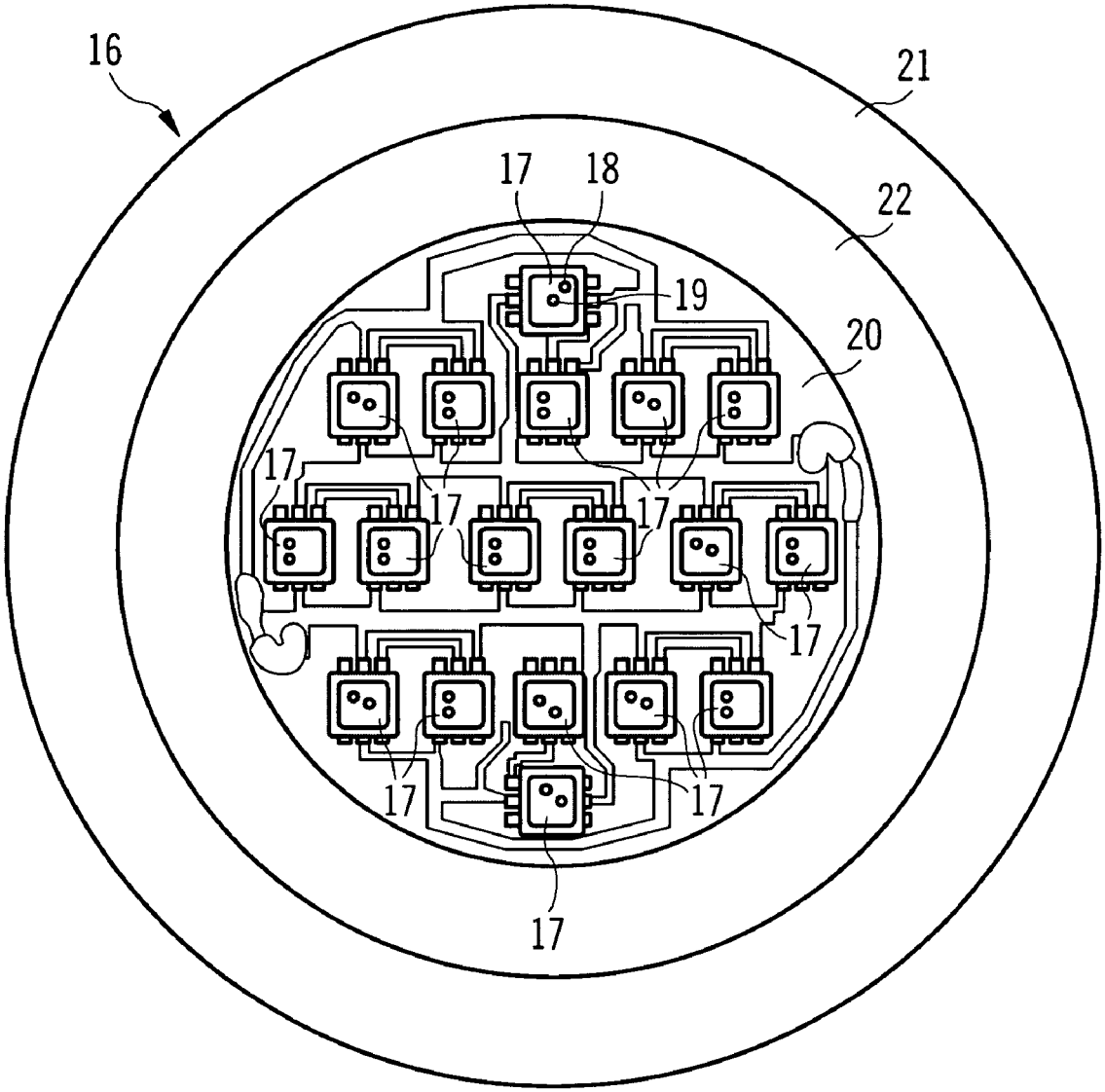
FIG. 4 shows a schematic illustration of an exemplary embodiment of a low-voltage luminous means which contains an LED circuit arrangement according to the invention.

FIG. 4 shows a plan view of an exemplary embodiment of a low-voltage luminous means 16 which contains an LED circuit arrangement according to the invention having eighteen multichip LEDs 17. Each of the multichip LEDs 17 preferably respectively contains three identically colored radiation-emitting LED chips, two LED chips 18, 19 of which respectively emit radiation at the same time. The multichip LEDs 17 are arranged on a printed circuit board 20 in a housing 21 which has a reflector 22 made from a metallized glass or plastic.

The invention is not restricted by the description on the basis of the exemplary embodiments. Rather, the invention includes any new feature and any combination of features, which includes, in particular, any combination of features in the patent claims even if this feature or this combination itself is not explicitly specified in the patent claims or exemplary embodiments.

We claim:

1. An LED circuit arrangement comprising:

an AC voltage source;

a first multichip LED comprising on a first substrate, a first pair of radiation-emitting LED chips and a third radiation-emitting LED chip; and a second multichip LED comprising on a second substrate, a second pair of radiation-emitting LED chips and a sixth radiation-emitting LED chip;

wherein the first and second multichip LEDs are coupled to each other so that the first and second pairs of radiation-emitting LED chips are configured to form a bridge rectifier coupled to the AC voltage source;

wherein the third and sixth radiation-emitting LED chips are configured to form a load of the bridge rectifier;

wherein the bridge rectifier is configured so that one of the first pair of radiation-emitting LED chips and one of the second pair of radiation-emitting LED chips are forward-biased for one half-wave of AC voltage from the AC voltage source, and the other of the first pair of radiation-emitting LED chips and the other of the second pair of radiation-emitting LED chips are forward-biased for the other half-wave of AC voltage from the AC voltage source; and wherein the third and sixth radiation-emitting LED chips are forward biased for both half-waves of the AC voltage from the AC voltage source.

2. The LED circuit arrangement as claimed in claim 1, wherein the radiation-emitting LED chips of the multichip LEDs emit light of the same color.

3. The LED circuit arrangement as claimed in claim 1, further comprising at least one electronic component for smoothing a DC voltage that is generated by the bridge rectifier.

4. The LED circuit arrangement as claimed in claim 3, wherein the electronic component is a capacitor.

5. The LED circuit arrangement as claimed in claim 1, further comprising a transformer.

6. The LED circuit arrangement as claimed in claim 1, wherein a mains voltage is provided as the AC voltage source.

7. A low-voltage luminous device comprising an LED circuit arrangement as claimed in claim 1.

8. The low-voltage luminous device as claimed in claim 7, further comprising a reflector made from a glass or plastic material.

9. The low-voltage luminous device as claimed in claim 7 being adapted for an operating voltage of 12 V.

10. A power supply unit comprising an LED circuit arrangement as claimed in claim 5, wherein the radiation-emitting LED chips that are rectifier diodes of the bridge rectifier simultaneously constitute an optical display for operation of the power supply unit.

11. The low-voltage luminous device as claimed in claim 7, further comprising a reflector made from a glass or plastic material that is provided with a metallization.

12. The low-voltage luminous device as claimed in claim 7, wherein the radiation-emitting LED chips of the multichip LEDs emit light of the same color.

13. The low-voltage luminous device as claimed in claim 7, further comprising at least one electronic component for smoothing a DC voltage that is generated by the bridge rectifier.

14. The low-voltage luminous device as claimed in claim 13, wherein the electronic component is a capacitor.

15. The low-voltage luminous device as claimed in claim 7, further comprising a transformer.

16. The power supply unit as claimed in claim 10, further comprising a reflector made from a glass or plastic material that is provided with a metallization.

17. The power supply unit as claimed in claim 10, being adapted for an operating voltage of 12 V.

18. The power supply unit as claimed in claim 10, wherein the radiation-emitting LED chips of the multichip LEDs emit light of the same color.

19. The power supply unit as claimed in claim 10, further comprising at least one electronic component for smoothing a DC voltage that is generated by the bridge rectifier.

* * * * *